United States Patent [19]

Arai et al.

[11] Patent Number: 4,818,351

[45] Date of Patent: Apr. 4, 1989

[54] METHOD FOR THE SURFACE TREATMENT OF AN IRON OR IRON ALLOY ARTICLE

[75] Inventors: Tohru Arai; Hironori Fujita; Yoshihiko Sugimoto; Yukio Ohta; Shigeo Moriyama; Akira Sato, all of Aichi, Japan

[73] Assignee: Kabushiki Kaisha Toyota Chuo Kenkyusho, Japan

[21] Appl. No.: 80,828

[22] Filed: Jul. 24, 1987

[30] Foreign Application Priority Data

Jul. 30, 1986 [JP] Japan ..... 61-179239
Nov. 12, 1986 [JP] Japan ..... 61-269220

[51] Int. Cl.[4] ..... C23C 8/32

[52] U.S. Cl. ..... 204/39; 148/15.5; 148/14

[58] Field of Search ..... 148/15.5, 15, 14; 204/39

[56] References Cited

U.S. PATENT DOCUMENTS 3,401,066 9/1968 Gnafimiller ..... 148/15.5

FOREIGN PATENT DOCUMENTS 0122529 10/1984 European Pat. Off.
646645 11/1950 United Kingdom ..... 148/15.5
854208 11/1960 United Kingdom ..... 148/15.5

*Primary Examiner*—Sam Silverberg
*Attorney, Agent, or Firm*—Berman, Aisenberg & Platt

[57] ABSTRACT

A surface layer which is composed of the carbonitride of at least one of vanadium and chromium is formed on an article made of iron or an iron alloy if the article, a material containing at least one of vanadium and chromium and a treating agent are heated together. The treating agent may be composed of at least one of the cyanides and cyanates of alkali metals and alkaline earth metals. The layer adhering closely to the article can be formed efficiently at a temperature which is so low that virtually no thermal strain may develop in the article.

20 Claims, 9 Drawing Sheets

(× 1000)

(× 400)

(× 400)

(×400)

(×400)

METHOD FOR THE SURFACE TREATMENT OF AN IRON OR IRON ALLOY ARTICLE

BACKGROUND OF THE INVENTION

1. Field of the Invention

This invention relates to a method for the surface treatment which forms a layer of the carbonitride of vanadium (V) or chromium (Cr) on the surface of any of such articles made of iron or an iron alloy as dies, jigs, tools and machine parts.

2. Description of the Prior Art

It is well known that if a layer of the carbide, nitride or carbonitride of vanadium or chromium is formed on the surface of an article made of iron or an iron alloy, it improves various properties of the article, including its resistance to wear, seizure, oxidation and corrosion. Therefore, there have so far been proposed a variety of methods which are intended to form such a surface layer.

For example, Japanese Laid-Open Patent Specifications Nos. 200555/1982 and 197264/1983 propose immersing an article of an iron alloy in a bath of molten chloride to form a layer of chromium carbide on its surface. Japanese Patent Publication No. 24697/1967 and United States Patent No. 4,242,151 propose nitriding an object of an iron alloy and chromizing it to form a layer of chromium carbonitride on its surface.

According to any of these methods, however, the article is heated at a temperature which is higher than the $A_{cl}$ transformation point of iron which is about 700° C. The heat is likely to develop in the article the stress which causes it to crack if it has a complicated shape. Moreover, it worsens the working environment, because treatment is done at high temperatures.

There have also been proposed methods which employ a temperature which is lower than about 700° C. They include CVD (chemical vapor deposition), PACVD (plasma assisted chemical vapor deposition) and PVD (physical vapor deposition employing halides of vanadium and chromium, as disclosed in, for example, Japanese Laid-Open Patent Specifications Nos. 653457/1980 and 154563/1980. These methods can form a surface layer without developing any thermal distortion in the article, as they employ a heating temperature which is lower than the $A_{cl}$ transformation point of iron. It is, however, difficult to form by any of those methods a layer having a uniform thickness and adhering closely to the surface of the article. They involve a complicated process which requires expensive facilities. Moreover, they require the presence of hydrogen or a reduced pressure which lowers the efficiency of the operation.

SUMMARY OF THE INVENTION

Under these circumstances, it is an article of this invention to provide a method which can form a layer of the carbonitride of vanadium or chromium adhering closely to the surface of an article made of iron or an iron alloy, efficiently by employing a very simple apparatus and heating the article at a low temperature so that no thermal strain may develop therein.

According to a first aspect of this invention, there is provided a method for the surface treatment of an article made of iron or an iron alloy which comprises preparing a material containing at least one of vanadium and chromium and a treating agent comprising at least one of cyanides and cyanates of alkali metal and alkaline earth metals, and heating the article in the presence of the material and the treating agent at a temperature not more than 650° C. so that at least one of vanadium and chromium, nitrogen and carbon may be diffused through the surface of the article to form thereon a surface layer composed of the carbonitride of at least one of vanadium and chromium.

According to a second aspect of this invention, there is provided a method for the surface treatment of an object made of iron or an iron alloy which comprises preparing a material containing at least one of vanadium and chromium and a treating agent comprising at least one of cyanides and cyanates of alkali metal and alkaline earth metals and at least one of the chlorides, borofluorides, fluorides, oxides, bromides, iodides, carbonates, nitrataes and borates of alkali metals and alkaline earth metals, and heating the article in the presence of the material and the treating agent at a temperature not more than 650° C. so that at least one of vanadium and chromium, nitrogen and carbon may be diffused through the surface of the article to form thereon a surface layer composed of the carbonitride of at least one of vanadium and chromium.

The use of the specific treating agent enables the formation of an excellent surface layer at a low temperature not exceeding 650° C. The use of such a low temperature substantially prevents the development of any thermal distortion in the iron or iron alloy of which the article is made, improves the ease of treatment and eliminates the consumption of a large amount of energy. As the layer is formed by diffusion, it has strong adhesion which cannot be achieved in any carbide or nitride layer formed by PVD not involving any diffusion. It also has a high degree of density and a practically satisfactory thickness.

These and other objects, features and advantages of this invention will become more apparent from the following description and the accompanying drawings.

BRIEF DESCRIPTION OF THE DRAWINGS

FIGS. 2, 8,9 and 11 are graphs showing the results of analysis by an X-ray microanalyzer of the surfaces of iron alloy articles treated by the method of this invention in EXAMPLES 1, 3, 4 and 5 respectively;

DETAILED DESCRIPTION OF THE INVENTION

Figure 1:
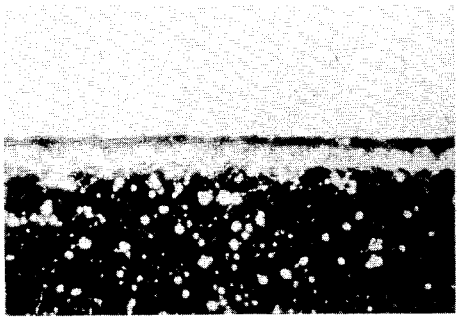
FIGS. 1, 7 and 10 are microphtographs of 1000, 400 and 400 magnifications, respectively, showing the cross-sectional structures of the surface layers formed by the method of this invention in EXAMPLES 1, 3 and 5, respectively, which will hereinafter be described.

According to this invention, a layer which is composed of the carbonitride of vanadium or chromium, or both, is formed on the surface of an article made of iron or an iron alloy. The article may be of any material containing carbon, such as carbon or alloy steel, cast iron or a sintered iron alloy, or of any material not containing carbon, such as pure iron. The material may or may not contain nitrogen.

The article is placed in a coexisting relationship with a material containing vanadium or chromium or both and a treating agent and they are heated together so that vanadium or chromium or both, nitrogen and carbon may be diffused through the surface of the article to form thereon a layer composed of the carbonitride of vanadium or chromium or both. This layer is a combination of an outer layer which is composed of the carbonitride consisting mainly of vanadium or chromium or both, and an inner layer which exists immediately under the outer layer and is composed of the carbonitride of iron. A diffusion layer, which is a solid solution of nitrogen in iron, is formed immediately under the inner layer.

The material containing vanadium or chromium or both is used to supply vanadium or chromium or both which are diffused through the surface of the article. In this connection, it is possible to use metals, alloys, or compounds thereof. Examples of the metals include metallic vanadium or chromium and the alloys thereof, such as ferrovanadium (Fe-V), ferrochromium (Fe-Cr). Example of the compounds include chlorides, fluorides and oxides, such as $VCl_3$, $VF_5$, $V_2O_5$, $CrCl_3$, $CrF_6$, $Cr_2O_3$ and more of these metals or compounds are employed. The use of metallic vanadium, chromium, ferrovanadium, ferrochromium, or a combination thereof, is particularly preferred from a practical standpoint.

The treating agent is used to supply nitrogen and carbon which are diffused through the surface of the article and also serves as a medium which assists the diffusion of vanadium or chromium or both therethrough. It is composed of one or more of the cyanides and cyanates of alkali metals and alkaline earth metals (hereinafter referred to as the first treating agent). It is also possible to use a mixture of the first treating agent and one or more of the chlorides, fluorides, borofluorides, oxides, bromides, iodides, carbonates, nitrates and borates and alkali metals and alkaline earth metals (hereinafter referred to as the second treating agent). The first treating agent supplies the nitrogen and carbon which are diffused through the surface of the article. The second treating agent is employed to control the melting point, viscosity, evaporation, etc. of the first treating agent and improve the stability of the treatment, if required.

More specifically, the first treating agent may, for example, be NaCN, KCN, NaCNO or KCNO, or a mixture thereof. The second treating agent may, for example, be NaCl, KCl, $CaCl_2$, LiCl, NaF, KF, LiF, $KBF_4$, $Na_2CO_3$, $LiCO_3$, $KCO_3$, $NaNO_3$ or $Na_2O$, or a mixture thereof.

When the material containing vanadium or chromium or both is mixed with the treating agent, it is preferable to employ 0.5 to 30% by weight of the material based on the weight of the treating agent. A deviation from this range makes it difficult to continuously form a surface layer. It appears that it is easier to continuously form a layer as the amount of the material which is employed approaches the middle value of the range.

Various methods can be employed for heating the article to be treated, etc. to form a surface layer on the article. They include a first method which involves immersion in a molten salt bath, a second method which involves the electrolysis in a molten salt, and a third method which involves the application of a paste.

According to the first method, the treating agent is melted to form a molten salt bath and the material containing vanadium or chromium or both and the article to be treated are immersed in the molten salt bath. When the material containing vanadium or chromium or both is immersed in the molten treating agent, vanadium or chromium or both are dissolved therein. The material which is immersed may, for example, be in the form of a powder having a particle size preferably under 200 mesh, or a thin plate. Alternatively, it may be a bar or plate serving as an anode so that the anodic dissolution of vanadium or chromium or both may take place in the molten salt bath. Vanadium or chromium or both are dissolved at a speed depending on the kind and size of the material which is employed. It is, therefore, necessary to age the molten salt bath by holding it at or about a preferred treating temperature for an appropriate length of time before the immersion of the article to be treated.

The anodic dissolution of vanadium or chromium, or both, proceeds quickly and thereby improves the efficiency of the treatment. It also has the advantage that no undissolved material collects in the bottom of the bath. A vessel which holds the molten salt bath, or another conductive material may be used as a cathode. The anodic dissolution proceeds at a high speed if the anode has a high current density. It is, however, sufficient to employ a relatively low current density insofar as no electrolysis is essentially required for dissolving vanadium, etc. It is practically appropriate to employ a current density of 0.1 to 0.8 $A/cm^2$.

The vanadium or chromium or both which have been dissolved, as well as the nitrogen and carbon which have been supplied by the treating agent, are diffused through the surface of the article to form thereon a layer which is composed of the carbonitride of vanadium or chromium or both. The vessel which holds the molten salt bath may be made of, e.g. graphite or steel. It is practically sufficient to use a steel vessel.

According to the second method, the material containing vanadium or chromium or both is immersed in a molten salt bath of the treating agent so that vanadium or chromium or both may be dissolved therein, and the article to be treated is immersed therein as a cathode, while a vessel which holds the molten salt bath, or a separate conductive material is used as an anode. Vanadium, etc. can be dissolved in a way which is similar to either of the ways which have hereinabove been described in connection with the first method. Alternatively, the material containing vanadium or chromium or both can be used as the anode, while the article to be treated serves as the cathode. This method has the advantage that the anodic dissolution of vanadium or chromium or both and the formation of a surface layer can be accomplished simultaneously. In any event, the cathode may have a current density of 2 $A/cm^2$ or below. A range of 0.05 to 1.0 $A/cm^2$ is practically appropriate.

Both of the first and second methods can be carried out either in an atmosphere exposed to the open air, or in the presence of a protective gas, such as nitrogen or argon.

According to the third method, a paste is prepared from a mixed powder of the treating agent and the material containing vanadium or chromium or both, or from a powder obtained by crushing a solidified product of a molten treating agent in which vanadium or chromium or both have been dissolved, and the article to be treated is coated with the paste and heated.

The paste can be prepared by adding to the powder an aqueous solution of dextrin, glycerin, water glass, ethylene glycol, alcohol, etc. as a binder. The paste is applied to the surface of the article to form a layer usually having a thickness of at least 1 mm. Then, the article is usually placed in a container and is heated in a heating furnace. It is usually sufficient to heat the article in an atmosphere exposed to the open air. If a protective gas atmosphere is employed, however, it is advantageously possible to apply a paste layer having a smaller thickness. The third method has the advantage of enabling the formation of a surface layer on only that part or parts of the article to which the paste has been applied. The powder from which the paste is prepared may have a particle size which enables it to pass through, say, a sieve of 100 mesh. The use of a somewhat coarser or finer powder may, however, not present any substantial problem.

According to this invention, it is important to employ a heating temperature not exceeding 650° C. in order to ensure that substantially no strain develop in the substrate, i.e. the iron or iron alloy of which the article to be treated is made. It is, however, desirable to employ a temperature which is not lower than 450° C. If any temperature that is lower than 450° C. is employed, the surface layer can only be formed very slowly. In practice, therefore, it is advisable to select a temperature of 500° C. to 600° C. which falls within the range of temperatures usually employed for the high temperature tempering of die steels or the tempering of structural steels.

With a longer treatment time, a thicker surface layer will result. Also, as the time is longer, the surface layer has a higher content of vanadium or chromium or both up to a certain period of time. Therefore, the length of time to be selected for the treatment depends on the desired thickness of the surface layer to be formed or its desired content of vanadium or chromium or both. It is usually in the range of 1 to 50 hours.

Referring to the thickness of the surface layer, it is practically advisable that it have a total thickness of, say, 3 to 15 microns, while the outer layer has a thickness of, say, 1 to 10 microns. A surface layer having a greater thickness is likely to bring about a reduction in toughness of the substrate.

The inventors of this invention are not yet certain about the mechanism through which this invention enables the formation of a surface layer composed of the carbonitride of vanadium or chromium or both. The following is, therefore, an assumption based on the results of their analysis by X-ray diffraction and an X-ray microanalyzer and their study of the relationship existing between the length of time spent for the treatment and the thickness of the layer thereby formed. In the following description, the letters "m", "n", "o" and "p" appearing as suffixes represent different numerals.

Nitrogen (N) and carbon (C) are diffused into the surface of the article made of iron or an iron alloy and react with iron (Fe) to form a layer of nitride which can be represented as $Fe_m(C,N)_n$. This nitride contains any carbon (C) or nitrogen (N) that the article may originally contain. A solid solution of nitrogen which can be represented as Fe-N is formed immediately under the nitride layer. These reactions gradually proceed from the surface of the article to its interior.

The diffusion of nitrogen and carbon is immediately followed by the diffusion of, e.g. vanadium (V) into the nitride layer and these two kinds of diffusion proceed together. The latter diffusion is a reaction which causes V to replace Fe in $Fe_m(C,N)_n$ and thereby convert the nitride to $(V, Fe)_o(C, N)_p$. This reaction also gradually proceeds from the surface of the article to its interior. This layer of $(V, Fe)_o(C,N)_p$ has an outer surface portion toward which it appears to contain a large amount of vanadium, and an inner surface portion contacting the substrate toward which it appears to contain a large amount of iron. Therefore, it may sometimes be more appropriate to express it as a layer of $V_o(C, N)_p$, insofar as its outer surface portion contains only a very small amount of iron.

At any rate, the surface layer which has been formed is composed of an outer layer of $(V, Fe)_o(C, N)_p$ and an inner layer of $Fe_m(C, N)_n$. Moreover, it is possible that other reactions may also take place to form a compound of at least one of V and Cr and N, or at least one of V and Cr, N and C on the surface of the substrate. The thicknesses of the outer and inner layers, the thickness of the layer formed by a solid solution of iron and nitrogen, the ratio of their thicknesses and their chemical compositions depend on the substrate which is employed, the temperature and time which are employed for the treatment, the treating agent which is employed, the mixing ratio of the substances which are employed to prepare the treating agent, etc. The same applies to cases where chromium, or vanadium and chromium, are employed.

The inventors of this invention have previously proposed a method which treats the surface of an article made of an iron alloy to form thereon a layer composed of the nitride or carbonitride of an element of Group Va of the periodic table, or chromium. This method constitutes the subject matter of our PCT Application No. 00287 (U.S. Pat. No. 23,862, Japanse Patent Application Nos. 131556/1985 and 178781/1985). This method essentially consists of two stages of treatment. The article is first subjected to nitriding treatment so that a nitrided layer composed of a compound of iron and nitrogen, or iron, carbon and nitrogen, may be formed on the surface of the article Then, the article is placed in a coexisting relationship with a material containing an element of Group Va of the periodic table or chromium and a treating agent which is composed of one or more of the chlorides, fluorides, borofluorides, oxides, bromides, iodides, carbonates, nitrates and borates of alkali metals and alkaline earth metals or one or both of an ammonium halide and a metal halide, and they are heated together at a temperature not exceeding 580° C., so that the Group Va element or chromium may be diffused into the nitrided layer to form on the article a surfce layer composed of the nitride or carbonitride of the Group Va element of chromium.

This prior method and the method of this invention are similar to each other in that they can both form a surface layer composed of the carbonitride of vanadium or chromium by employing a salt bath or paste process at a temperature which is sufficiently low to prevent substantially the development of any thermal strain in the substrate. This invention can, however, be significantly distinguished from the prior method in a number of other respects including the following:

(A) Mechanism for the Formation of a Carbonitride Layer

The prior method includes the first stage of treatment which forms a nitrided layer composed of a compound of iron and nitrogen, or iron, carbon and nitrogen, and the second stage of treatment which substitutes a Group Va element or chromium for iron in the nitrided layer to form a layer composed of the nitride or carbonitride of the Group Va element or chromium. Therefore, the surface layer which can finally be obtained has only a maximum thickness that is equal to the thickness of the nitrided layer formed by the first stage of treatment. In other words, the thickness of the surface layer is dictated by the first stage of treatment.

According to this invention, however, it is possible to form a surface layer, including both of its outer portion composed of the carbonitride consisting mainly of vanadium or chromium or both and its inner portion composed of iron carbonitride, with a thickness which apparently increases substantially in proportion to the half power of the length of time spent for the treatment, as will be obvious from the description of examples.

(B) Properties of the Product of Treatment

The products of the two methods under comparison greatly differ from each other in toughness, though they do not make any substantial difference in surface hardness, or wear or seizure resistance.

Referring to nitriding treatment in general, it is usual practice to avoid the formation of a layer of any compound on the surface of the substrate so that it may not lower its toughness. The prior method, however, makes it essential to form a layer of a compound having a large thickness. This necessarily results in the formation of a layer of a solid solution of iron and nitrogen which also as a large thickness. The presence of a large amount of nitrogen in solid solution is obvious from the results of analysis by an X-ray microanalyzer which will be referred to in further detail in the description of examples. The presence of these layers have an adverse effect on the toughness of the substrate.

On the other hand, the product of treatment by this invention contains a by far smaller amount of nitrogen forming a solid solution with iron in the substrate and includes a layer of any such solid solution having a by far smaller thickness, as will be obvious from the description of examples. Therefore, it apparently has a higher degree of toughness than any product of treatment by the prior method.

(C) Efficiency

The method of this invention, which can form a surface layer by a single stage of treatment, is more efficient than the prior method which requires two different stages of treatment. Moreover, the method of this invention can be carried out by a smaller amount of facilities, insofar as it involves only a single stage of treatment.

The invention will now be described more specifically with reference to a variety of examples.

EXAMPLE 1

A heat resistant vessel holding a mixture consisting of 53% by weight of NaCNO, 12% by weight of KCl and 35% by weight of $CaCl_2$ was heated in an electric furnace in an atmospheric environment, whereby a molten salt bath having a temperature of 570° C. was prepared from those substances. A powder of ferrovanadium (Fe-V; JIS FV1) having a particle size under 100 mesh was added to the molten salt bath until it occupied 15% by weight of the molten salt bath. A plurality of samples of the material to be treated were immersed in the molten salt bath and after they had been held therein for a period of 1 to 50 hours, they were taken out and cooled by air. Each sample was a round bar of JIS-SKH 51 high speed tool steel having a diameter of 6 mm and a length of 20 mm. Each sample was ground to expose a cross-sectional surface after any unnecessarily adhering bath material had been washed away, and the cross-sectional structure of the surface layer which had been formed thereon was examined through a microscope.

Figure 2:
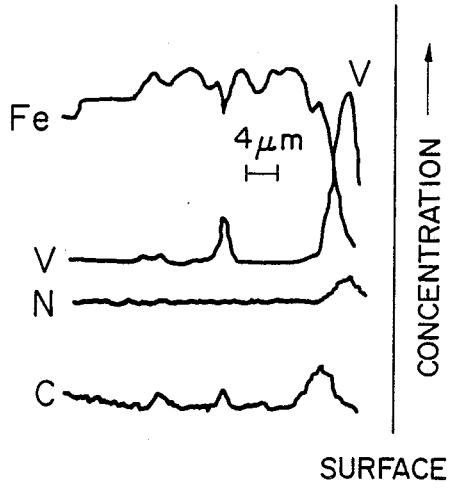

FIG. 1 is a microphotograph of 1000 magnifications showing by way of example the cross-sectional structure of the surface layer formed by eight hours of immersion treatment. It was a layer having a smooth surface and composed of an inner layer and an outer layer. The cross-sectional structure of this sample was analyzed by an X-ray microanalyzer. The results are shown in FIG. 2. Nitrogen and carbon, as well as vanadium and iron, were found in the surface layer. More vanadium and nitrogen were found in the outer layer than in the inner layer, while more iron and carbon were found in the inner layer. Only a very small amount of a solid solution of nitrogen was found in the substrate immediately under the surface layer. The analysis of the layer through its outer surface indicated the presence of about 50% of vanadium. The analysis of the layer by X-ray diffraction showed diffraction patterns corresponding to those of VC, VN and $Fe_3C$. Accordingly, it was evident that the inner layer was a layer of iron carbonitride expressed as $Fe_m(C, N)_n$, while the outer layer was a layer of the carbonitride of vanadium and iron expressed as $(V, Fe)_o(C, N)_p$.

Figure 3:
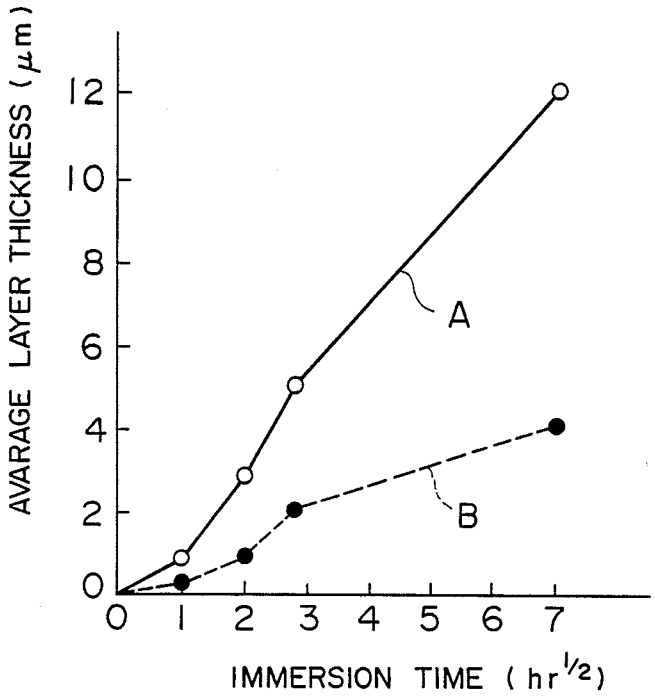
FIG. 3 is a graph showing the thickness of the surface layer formed in EXAMPLE 1 in relation to the length of immersion time.

The four samples which had been treated by employing four different lengths of immersion time, respectively, from the range of 1 to 50 hours were examined for their respective cross-sectional structures, whereby the thickness of the surface layer on each sample was determined. The results are shown in FIG. 3. In FIG. 3, curve A shows the total thickness of the inner layer of $Fe_m(C, N)_n$ and the outer layer of $(V, Fe)_o(C, N)_p$, while curve B shows the thickness of the outer layer alone. The total thickness of the inner and outer layers and the thickness of the outer layer were both found to increase substantially in proportion to the half power of the immersion time.

The surface layer on each sample was subjected to a peel strength test. It was done by employing a Rockwell hardness tester and dropping an indenter under the conditions employed for a C-scale test to see what would happen around an indentation. About ten cracks appeared in the surface layer radially of the indentation apparently due to the tensile stress which acted on the layer when the substrate bulged around the indentation. However, the layer did not spall, but showed a satisfactorily high peel strength. For the sake of comparison, a similar test was conducted on a layer of TiN which had been formed by ionic plating. The result was the complete separation of an annular layer portion surrounnding an indentation. A similar test was also conducted on a layer of VC which had been formed in a molten salt bath having a temperature of 1000° C. The result was the appearance of cracks similar to those which had appeared on the samples of this invention. EXAMPLE 2

Surface layers were formed on a plurality of samples by repeating the procedure of EXAMPLE 1, except that a powder of metallic chromium was used instead of the ferrovanadium powder. Each sample was ground to expose a cross-sectional surface after any unnecessarily adhering bath material had been washed away, and the cross-sectional structure of its surface layer was examined through a microscope.

Figure 4:
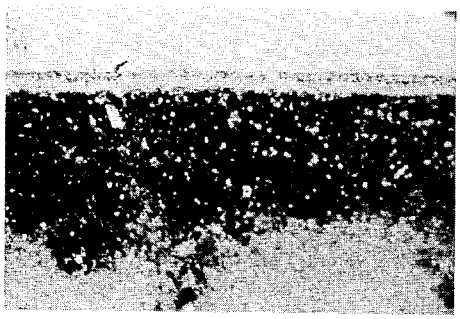
FIGS. 4 and 12 are microphotographs of 400 magnifications showing the cross-sectional structures of the surface layers formed by the method of this invention in EXAMPLES 2 and 8, respectively, which will hereinafter be described.
Figure 5:
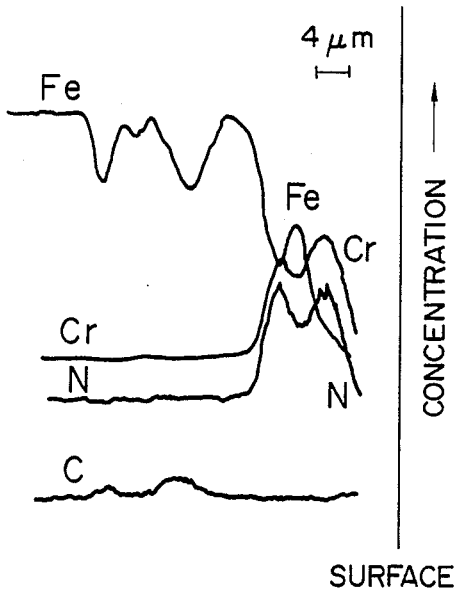
FIGS. 5, 13, 14 and 15 are graphs showing the results of analysis by an X-ray microanalyzer of the surfaces of iron alloy articles treated by the method of this invention in EXAMPLES 2, 8, 14 and 15, respectively, which will hereinafter be described.

FIG. 4 is a microphotograph of 400 magnifications showing by way of example the cross-sectional structure of the surface layer formed by eight hours of immersion treatment. It was a single layer having a smooth surface. The cross-sectional structure of this sample was analyzed by an X-ray microanalyzer. The results are shown in FIGURE 5. Nitrogen and carbon, as well as chromium and iron, were found in the layer. A layer of a solid solution of nitrogen and carbon with iron was found immediately under the surface layer, but contained only a very small amount of nitrogen, as was the case with all of the other examples of this invention. The analysis of the surface layer through its outer surface indicated the presence of about 60% of chromium. The analysis of the layer by X-ray diffraction showed diffraction patterns corresponding to those of CrN, $Cr_2N$ and $Fe_3C$. Accordingly, it was evidently a layer of the carbonitride of chromium and iron which was composed of a mxture consisting mainly of CrN, $Cr_2N$ and $Fe_3C$.

Figure 6:
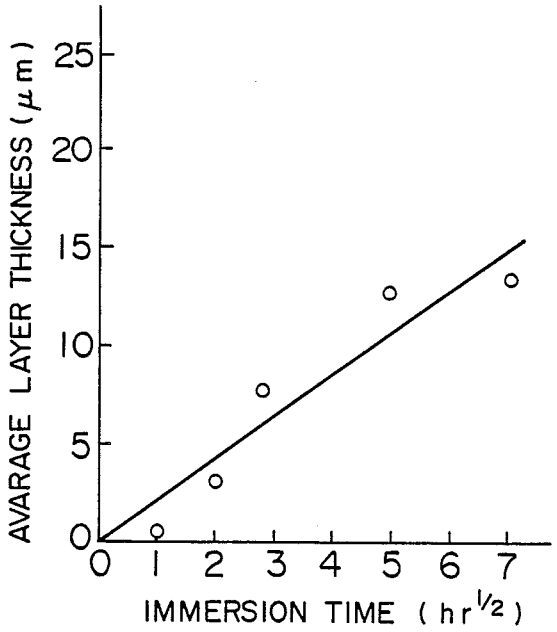
FIG. 6 is a graph showing the thickness of the surface layer formed in EXAMPLE 2 in relation to the length of immersion time.

The four samples which had been treated by employing four different lengths of immersion time, respectively, from the range of 1 to 50 hours were examined for their respective cross-sectional structures, whereby the thickness of the surface layer on each sample was determined. The results are shown in FIG. 6. The thickness of the layer was found to increase substantially in proportion to the half power of the length of immersion time.

The surface layer on each sample was subjected to a peel strength test. It was conducted by employing a Rockwell hardness tester and dropping an indenter under the conditions employed for a C-scale test to see what would happen around an indentation. About ten cracks appeared in the surface layer radially of the indentation apparently due to the tensile stress which acted on the layer when the substrate bulged around the indentation. However, the layer did not spall, but showed a satisfactorily high peel strength. For the sake of comparison, a similar test was conducted on a layer of TiN which had been formed by ionic plating. It resulted in the complete separation of an annular layer portion surrounding the indentation.

EXAMPLE 3

A heat resistant steel vessel holding a mixture consisting of 57% by weight of NaCNO, 13% by weight of NaCN, 9% by weight of NaCl and 21% by weight of $CaCl_2$ was heated in an electric furnace in an atmospheric environment, whereby a molten salt bath having a temperature of 550° C. was prepared from those substances. A powder of $VCl_3$ having a particle size under 320 mesh was added to the vessel until it occupied 15% by weight of the molten salt bath. A sample in the form of a round bar of JIS-S45C carbon steel having a diameter of 8 mm and a length of 2 mm was immersed in the molten salt bath. After eight hours, it was taken out and cooled by air.

Figure 7:
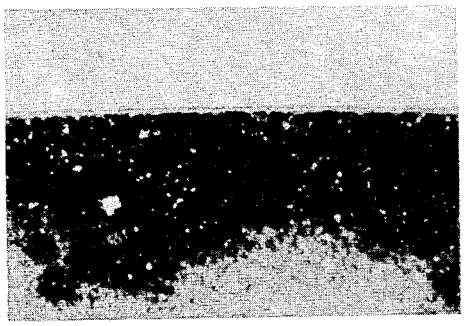
Figure 8:
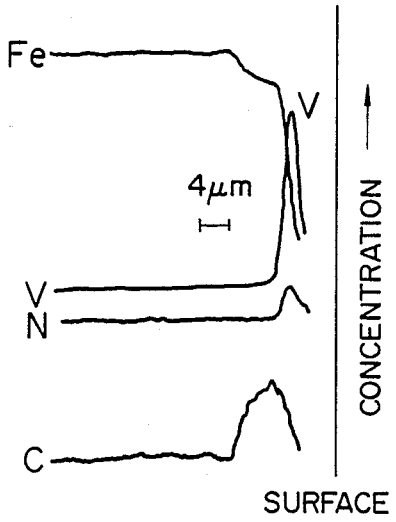

FIG. 7 is a microphotograph of 400 magnifications showing the cross-sectional structure of the sample. The surface layer which had been formed thereon was a double layer which was similar to what had been obtained in EXAMPLE 1. The analysis of the layer by X-ray diffraction and by an X-ray microanalyzer indicated that it was composed of an inner layer of iron carbonitride expressed as $Fe_m(C, N)_n$ and an outer layer of the carbonitride of vanadium and iron expressed as $(V, Fe)_o(C, N)_p$. The results of the analysis by the microanalyzer are shown in FIG. 8.

The procedure of EXAMPLE 1 was repeated for conducting a similar peel strength test by a Rockwell hardness tester. Although the layer cracked in a similar pattern, it was found to have a satisfactorily high peel strength.

EXAMPLE 4

A graphite vessel holding a mixture consisting of 53% by weight of NaCNO, 12% by weight of KCl and 35% by weight of $CaCl_2$ (i.e. of the same composition with the mixture employed in EXAMPLE 1) was heated in an electric furnace in an atmospheric environment, whereby a molten salt bath having a temperature of 570° C. was prepared. A plate of Fe-V (JIS FV1) having a length of 60 mm, a width of 30 mm and a thickness of 4 mm was placed in the center of the molten salt bath. An electric current was passed through the bath between the ferrovanadium plate serving as an anode and the graphite vessel serving as a cathode for about 16 hours in such a way that the anode might have a current density of 0.6 $A/cm^2$. The resulting weight loss of the ferrovanadium sheet indicated that as a result of anodic dissolution, the bath contained about 6% of vanadium. A sample in the form of a round bar of JIS SKH51 high speed tool steel having a diameter of 6 mm and a length of 15 mm was immersed in the molten salt bath and after 25 hours, it was taken out and cooled by air.

Figure 9:
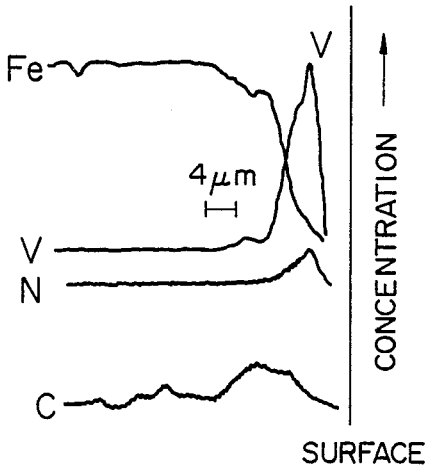

The sample was cut to expose a cross-sectional surface and the cross-sectional structure of the surface layer which had been formed thereon was examined by an optical microscope and an X-ray microanalyzer. It was a double layer composed of an inner layer and an outer layer. Nitrogen and carbon, as well as vanadium and iron, were found in the surface layer as a whole, and more vanadium and nitrogen were found in the outer layer than in the inner layer, while more iron and carbon were found in the inner layer, as shown in FIG. 9. The analysis of the layer by X-ray diffraction gave diffraction patterns corresponding to those of VC, VN and $Fe_3C$.

The layer showed a high peel strength which was comparable to what had been obtained in EXAMPLE 1 or 3.

EXAMPLE 5

A graphite vessel holding a mixture consisting of 51% by weight of NaCNO, 21% by weight of NaCl and 28% by weight of $Na_2CO_3$ was heated in an electric furnace in an atmospheric environment, whereby a molten salt bath having a temperature of 570° C. was prepared from those substances. A powder of Fe-V (JIS FV1) having a particle size under 100 mesh was added to the vessel until it occupied 20% by weight of the molten salt bath. A sample in the form of a round bar of JIS-S45C carbon steel having a diameter of 8 mm and a length of 20 mm was immersed in the bath. Electrolysis was conducted by passing an electric current through the bath between the steel bar serving as a cathode and the graphite vessel serving as an anode for a period of eight hours in such a way that the cathode might have a current density of 0.05 A/cm$^2$. Then, the sample was taken out of the bath and cooled by air.

Figure 10:
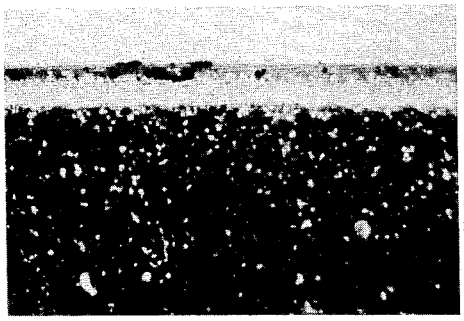

The sample was cut and its cross-sectional structure was examined through an optical microscope. FIGURE 10 is a microphotograph showing the cross-sectional structure of the surface layer which had been formed on the sample. It was a double layer composed of an inner and an outer layer. FIG. 11 shows the results of analysis by an X-ray microanalyzer. More vanadium and nitrogen were found in the outer layer than in the inner layer, and more iron and carbon in the inner layer. These results were all comparable to what had been obtained from the other examples of this invention.

EXAMPLE 6

A mixture consisting of 45% by weight of NaCNO, 10% by weight of KCl, 25% by weight of $CaCl_2$ and 20% by weight of a powder of Fe-V (JIS FV1) was heated to a temperature of 650° C. and the molten mixture was carefully stirred to form a uniform bath. One part by weight of graphite and one part by weight of alumina powder were added to four parts by weight of the bath. They were carefully mixed to prepare a treating agent.

The treating agent was cooled and pulverized. Ethyl alcohol was added to the pulverized treating agent to form a slurry thereof. The slurry was applied to the surface of a sample of JIS S45C carbon steel to form a layer having a thickness of about 5 mm. After the slurry had been dried, the sample was heated at 570° C. for eight hours in a nitrogen atmosphere and was, then, cooled.

After the remaining treating agent had been removed from the sample, the surface layer which had been formed thereon was analyzed by X-ray diffraction and by an X-ray microanalyzer. It was a double layer including an inner layer of iron carbonitride expressed as $Fe_m(C, N)_n$ and an outer layer of the carbonitride of vanadium and iron expressed as $(V, Fe)_o(C, N)_p$. It was comparable to the layer which had been obtained in EXAMPLE 1.

EXAMPLE 7

A heat resistant vessel holding a mixture consisting of 53% by weight of NaCNO, 12% by weight of KCl and 35% by weight of $CaCl_2$ (i.e. of the same composition with the mixture employed in EXAMPLE 1 was heated in an electric furnace in an atmospheric environment, whereby a molten salt bath having a temperature of 570° C. was prepared from those substances. A powder of ferrovanadium (Fe-V; JIS FV1) having a particle size under 100 mesh was added to the vessel until it occupied 15% by weight of the molten salt bath. A sample in the form of a round bar of JIS SKH51 steel having a diameter of 6.5 mm and a length of 40 mm, which had been hardened and tempered under standard conditions, was immersed in the bath and after eight hours, it was taken out and cooled by air. After the remaining bath material had been washed away, the surface layer which had been formed on the sample was subjected to analysis by X-ray diffraction. It gave diffraction patterns corresponding to those of VC, VN and $Fe_3C$.

The sample (hereinafter referred to as Sample No. 1) was subjected to a dry friction test by a Falex lubricant testing machine employing a piece of gas carburized JIS-SCM415 chromium molybdenum steel as a counter material. The test was continued for a period of four minutes at a load of 200 kg, a rotating speed of 300 rpm and a sliding speed of 0.1 m/sec. For the sake of comparison, a similar test was conducted on each of a sample of JIS-SKH51 steel as hardened and tempered (Sample No. S1) and a sample of SKH51 steel as nitrided (Sample No. S2).

Sample No. S1 showed a wear of about 17 mg/cm$^2$. It showed a coefficient of friction which was as high as 0.280 when measured 30 seconds after the test had been started. Sample No. S2 showed a wear of about 15 mg/cm$^2$ and its coefficient of friction was as high as 0.265 when measured 30 seconds after the test had been started. On the other hand, Sample No. 1 embodying this invention showed a wear which was as small as about 3 mg/cm$^2$ and its coefficient of friction was as low as 0.150 when measured 30 seconds after the test had been started.

A similar friction test was also conducted on each of a sample of JIS-SKH51 steel which had been coated with a layer of vanadium carbide (VC) having a thickness of about three microns by 1.5 hours of immersion in a molten salt bath having a temperature of 1020° C. and a sample of the same steel which had been coated with a layer of titanium carbonitride expressed as Ti(C,N) and having a thickness of eight microns by four hours of CVD at 850° C. The wear of each of these samples and its coefficient of friction were both substantially equal to those of Sample No. 1. Therefore, it is obvious that the surface layer which can be formed in accordance with the method of this invention is comparable in wear and seizure resistance to any surface layer formed by immersion in a high temperature molten salt bath or by CVD.

EXAMPLE 8

A graphite vessel holding a mixture consisting of 57% by weight of NaCNO, 13% by weight of NaCN, 9% by weight of NaCl and 21% by weight of $CaCl_2$ was heated in an electric furnace in an atmospheric environment, whereby a molten salt bath having a temperature of 550° C. was prepared from those substances. A powder of $CrCl_3$ having a particle size under 320 mesh was added to the vessel until it occupied 15% by weight of the molten salt bath. A sample in the form of a round bar of JIS-S45C steel having a diameter of 8 mm and a length of 20 mm was immersed in the bath and after four hours, it was taken out and cooled by air.

Figure 12:
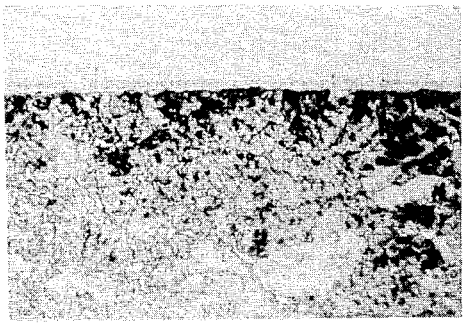
Figure 13:
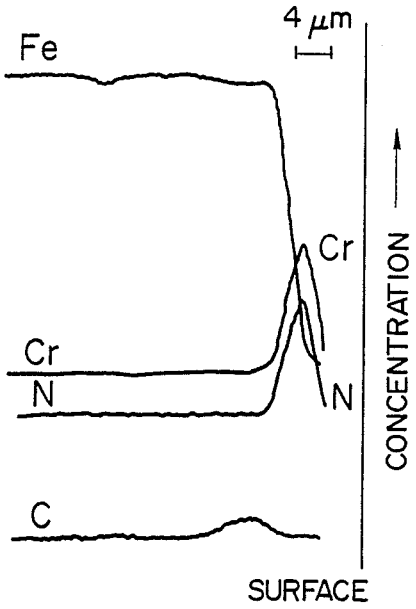

FIG. 12 is a microphotograph of 400 magnifications showing the cross-sectional structure of the surface layer formed on the sample. It was a single layer having a smooth surface which was similar to the layer obtained in EXAMPLE 2. The analysis of the layer by X-ray diffraction and its analysis by an X-ray microanalyzer, of which the results are shown in FIG. 13, showed that it was a layer of the carbonitride of chromium and iron consisting mainly of a mixture of CrN, $Cr_2N$ and $Fe_3C$.

The procedure of EXAMPLE 2 was repeated for conducting a peel strength test on the layer by a Rockwell hardness tester. Although it formed a similar pattern of cracks, it was found to be a layer having a satisfactorily high peel strength.

EXAMPLE 9

A heat resistant steel vessel holding a mixture consisting of 42% by weight of KCl, 38% by weight of NaCN, 14% by weight of KF and 6% by weight of LiF was heated in an electric furnace in an atmospheric environment, whereby a molten salt bath having a temperature of 550° C. was prepared from those substances. A powder of metallic chromium having a particle size under 100 mesh was added to the vessel until it occupied 15% by weight of the molten salt bath. A sample in the form of a round bar of JIS-SKD11 steel having a diameter of 8 mm and a length of 15 mm was immersed in the bath and after eight hours, it was taken out and cooled by air.

After the remaining treating agent had been removed from the sample, it was subjected to analysis by X-ray diffraction and by an X-ray microanalyzer. The surface layer which had been formed thereon was a layer of the carbonitride of chromium and iron consisting mainly of a mixture of CrN, $Cr_2N$ and $Fe_3C$.

EXAMPLE 10

A heat resistant vessel holding a mixture consisting of 46% by weight of NaCNO, 19% by weight of NaCl, 25% by weight of $Na_2CO_3$ and 10% by weight of LiBr was heated in an electric furnace in an atmospheric environment, whereby a molten salt bath having a temperature of 600° C. was prepared from those substances. A powder of ferrochromium (Fe-Cr) having a particle size under 100 mesh was added to the vessel until it occupied 15% by weight of the molten salt bath. A sample in the form of a round bar of JIS-SKH51 steel having a diameter of 6 mm and a length of 20 mm was immersed in the bath and after 16 hours, it was taken out and cooled by air.

The sample was cut and the cross-sectional structure of the layer which had been formed on its surface was subjected to analysis by X-ray diffraction and by an X-ray microanalyzer. It was a layer of the carbonitride of chromium and iron which was similar to those obtained in some other examples.

EXAMPLE 11

A heat resistant steel vessel holding a mixture consisting of 46% by weight of NaCNO, 19% by weight of NaCl, 25% by weight of $Na_2CO_3$ and 10% by weight of KI was heated in an electric furnace in an atmospheric environment, whereby a molten salt bath having a temperature of 600° C. was prepared from those substances. A powder of chromium fluoride ($CrF_6$) having a particle size under 100 mesh was added to the vessel until it occupied 15% by weight of the molten salt bath. A sample in the form of a round bar of JIS-SKD steel having a diameter of 8 mm and a length of 15 mm was immersed in the bath and after eight hours, it was taken out and cooled by air.

The sample was cut and the cross-sectional structure of the layer which had been formed on its surface was subjected to analysis by X-ray diffraction and by an X-ray microanalyzer. It was a layer of the carbonitride of chromium and iron.

EXAMPLE 12

A heat resistant steel vessel holding a mixture consisting of 73% by weight of NaCNO, 8% by weight of $NaNO_2$, 8% by weight of $KNO_3$ and 11% by weight of $Na_2CO_3$ was heated in an electric furnace in an atmospheric environment, whereby a molten salt bath having a temperature of 530° C. was prepared from those substances. A powder of metallic chromium having a particle size under 100 mesh was added to the vessel until it occupied 15% by weight of the molten salt bath. A sample in the form of a round bar of JIS-SKD61 alloy tool steel having a diameter of 8 mm and a length of 15 mm was immersed in the bath and after six hours, it was taken out and cooled by air.

The sample was cut and the cross-sectional structure of the layer which had been formed on its surface was subjected to analysis by X-ray diffraction and by an X-ray microanalyzer. It was also a layer of the carbonitride of chromium and iron.

EXAMPLE 13

A heat resistant steel vessel holding a mixture consisting of 44% by weight of NaCN, 36% by weight of KCN and 20% by weight of $Na_2B_4O_7$ was heated in an electric furnace in an atmospheric environment, whereby a molten salt bath having a temperature of 650° C. was prepared from those substances. A powder of metallic chromium having a particle size under 100 mesh wad added to the vessel until it occupied 15% by weight of the molten salt bath. A sample in the form of a round bar of JIS-SKD61 steel having a diameter of 8 mm and a length of 15 mm was immersed in the bath and after four hours, it was taken out and cooled by air.

The sample was cut and the cross-sectional structure of the layer which had been formed on its surface was subjected to analysis by X-ray diffraction and by an X-ray microanalyzer. It was also a layer of the carbonitride of chromium and iron.

EXAMPLE 14

A graphite vessel holding a mixture consisting of 53% by weight of NaCNO, 12% by weight of KCl and 35% by weight of $CaCl_2$ (i.e. of the same composition with the mixture employed in EXAMPLE 2) was heated in an electric furnace in an atmospheric environment, whereby a molten salt bath having a temperature of 570° C. was prepared from those substances. A plate of metallic chromium having a length of 40 mm, a width of 35 mm and a thickness of 4 mm was placed in the center of the bath. An electric current was passed through the bath between the chromium plate serving as an anode and the graphite vessel serving as a cathode for a period of about 15 hours in such a way that the aonde might have a current density of 0.8 $A/cm^2$. The weight which the chromium plate had lost indicated that the bath contained about 7% of chromium as a result of anodic dissolution. A sample in the form of a round bar of JIS SKH51 steel having a diameter of 6 mm and a length of 15 mm was immersed in the bath and after 24 hours, it was taken out and cooled by air.

Figure 14:
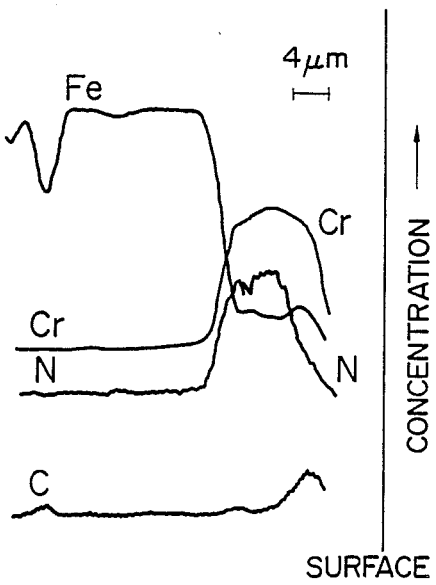

The sample was cut and the cross-sectional structure of the layer which had been formed on its surface was analyzed by an X-ray microanalyzer. It was found to contain carbon, as well as chromium, iron and nitrogen, as shown in FIG. 14. The analysis of the layer by X-ray diffraction showed diffraction patterns corresponding closely to those of CrN, $Cr_2N$ and $Fe_3C$. Therefore, it was evidently a layer of the carbonitride of chromium and iron.

The layer also showed a high peel strength which was comparable to what had been obtained in EXAMPLE 2 or 8.

EXAMPLE 15

A graphite vessel holding a mixture consisting of 51% by weight of NaCNO, 21% by weight of NaCl and 28% by weight of $Na_2CO_3$ was heated in an electric furnace in an atmospheric environment, whereby a molten salt bath having a temperature of 570° C. was prepared from those substances. A powder of Fe-Cr having a particle size under 200 mesh was added to the vessel until it occupied 19% of the molten salt bath. A sample in the form of a round bar of JIS-SKH51 steel having a diameter of 6 mm and a length of 15 mm was immersed in the bath. Electrolysis was conducted by passing an electric current through the bath between the graphite vessel serving as an anode and the sample serving as a cathode for a period of four hours in such a way that the cathode might have a current density of 0.05 A/cm$^2$. Then, the sample was taken out of the bath and cooled by air.

Figure 15:
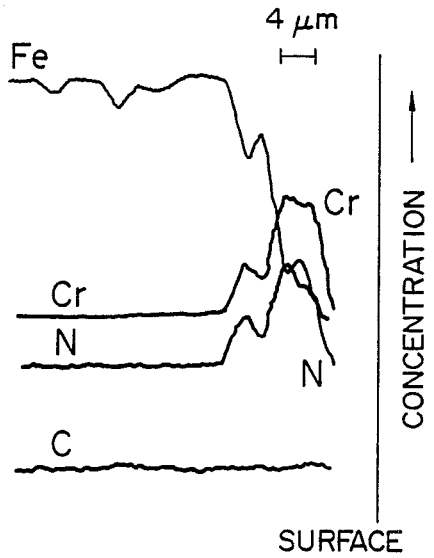

The sample was cut and the cross-sectional structure of the layer which had been formed on its surface was analyzed by an X-ray microanalyzer. The results are shown in FIG. 15. It was also a layer containing Cr, Fe, N and C.

EXAMPLE 16

A mixture consisting of 48% by weight of NaCN, 32% by weight of KCN and 20% by weight of a powder of metallic chromium having a particle size under 100 mesh was heated to 650° C. It was carefully stirred to form a uniform molten salt bath. One part by weight of graphite and one part by weight of alumina powder were added to four parts by weight of the bath. They were carefully mixed to prepare a treating agent in form of slurry.

The treating agent was cooled and pulverized. Ethyl alcohol was added to the pulverized treating agent to form a slurry thereof. The slurry was applied to the surface of a sample in the form of a plate of JIS-SKH51 steel having a width of 15 mm, a length of 50 mm and a thickness of 10 mm to form thereon a layer having a thickness of about 5 mm. After the slurry had been dried, the sample was heated at 570° C. for eight hours in a nitrogen atmosphere and was thereafter cooled.

After the remaining treating agent had been removed from the sample, the surface layer which had been formed thereon was subjected to analysis by X-ray diffraction and by an X-ray microanalyzer. It was a layer of the carbonitride of chromium and iron consisting mainly of a mixture of CrN, $Cr_2N$ and $Fe_3C$.

EXAMPLE 17

A heat resistant vessel holding a mixture consisting of 53% by weight of NaCNO, 12% by weight of KCl and 35% by weight of $CaCl_2$ (i.e. of the same composition with the mixture employed in EXAMPLE 1) was heated in an electric furnace in an atmospheric environment, whereby a molten salt bath having a temperature of 570° C. was prepared from those substances. A powder of metallic chromium having a particle size under 100 mesh was added to the vessel until it occupied 15% by weight of the molten salt bath. A sample in the form of a round bar of JIS-SKH51 steel having a diameter of 6.5 mm and a length of 40 mm, which had been hardened and tempered under standard conditions, was immersed in the bath and after eight hours, it was taken out and cooled by air. After the remaining bath material had been washed away, the surface layer which had been formed on the sample was analyzed by X-ray diffraction. It showed diffraction patterns corresponding to those of CrN, $Cr_2N$ and $Fe_3C$.

The sample (Sample No. 2) was subjected to a friction test by a Falex lubricant testing machine employing a piece of gas carburized JIS-SCM415 chromium molybdenum steel as a counter material. The test was continued for four minutes at a load of 400 kg, a rotating speed of 300 rpm and a sliding speed of 0.1 m/sec. For the sake of comparison, a similar test was conducted on each of a smaple of JIS-SKH51 steel as hardened and tempered (Sample No. S3) and a sample ofthe same steel as nitrided (Sample No. S4).

Sample No. S3 showed a wear of about 17 mg/cm$^2$. It showed a coefficient of friction which was as high as 0.280 when measured 30 seconds after the test had been started. Sample No. S4 showed a wear of about 15 mg/cm$^2$, and a coefficient of friction which was as high as 0.265 when measured 30 seconds after the test had been started. On the other hand, Sample No. 2 embodying this invention showed only a wear of about 2.5 mg/cm$^2$, and a coefficient of friction which as low as 0.093 when measured 30 seconds after the test had been started.

What is claimed is:

1. A method for forming a surface layer composed of a carbonitride of vanadium, a carbonitride of chromium, or a carbonitride of vanadium and chromium on the surface of an iron or iron alloy article, comprising preparing (a) a material containing vanadium, chromium or a combination of vanadium and chromium and (b) a treating agent comprising an alkali-metal cyanide, an alkali-metal cyanate, an alkaline-earth-metal cyanide, an alkaline-earth-metal cyanate, or a combination of any of the foregoing, and heating said article in the presence of said material and said treating agent at a temperature of not more than 650° C., thereby diffusing nitrogen, carbon, and vanadium or chromium or vanadium and chromium into the surface of said article.

2. A method according to claim 1, wherein said material comprises a member selected from the group of metallic vanadium, metallic chromium, a vanadium alloy, a chromium alloy, a vanadium compound, a chromium compound, and a combination of any of the foregoing.

3. A method according to claim 1, wherein the amount of said material is from 0.5 to 30% by weight of said treating agent.

4. A method according to claim 1, wherein said material and said article are immersed in a molten salt bath containing said treating agent.

5. A method according to claim 1, comprising subjecting the article to electrolysis by immersing said article in a molten salt bath containing said material and said treating agent, and employing said article as a cathode.

6. A method according to claim 1, wherein said material and said treating agent, both in powder form, are mixed and formed into a paste, said paste being applied to said article prior to said heating.

7. A method according to claim 1, wherein said temperature is at least 450° C.

8. A method according to claim 1, wherein said treating agent further comprises alkali-metal chloride, alkali-metal fluoride, alkali-metal borofluoride, alkali-metal oxide, alkali-metal bromide, alkali-metal iodide, alkali-metal carbonate, alkali-metal nitrate, alkali-metal borate, alkaline-earth-metal chloride, alkaline-earth-metal fluoride, alkaline-earth-metal borofluoride, alkaline-earth-metal oxide, alkaline-earth-metal bromide, alkaline-earth-metal iodide, alkaline-earth-metal carbonate, alkaline-earth-metal nitrate, alkaline-earth-metal borate, or any combination of the foregoing.

9. A method according to claim 8, wherein said material comprises a member selected from the group consisting of metallic vanadium, metallic chromium, a vanadium alloy, a chromium alloy, a vanadium compound, a chromium compound, and any combination of the foregoing.

10. A method according to claim 8, wherein said material is employed in a quantity which is equal to from 0.5 to 30% by weight of said treating agent.

11. A method according to claim 8, wherein said material and said article are immersed together in a molten salt bath containing said treating agent.

12. A method according to claim 8, comprising subjecting the article to electrolysis in a molten salt bath containing said material and said treating agent, and employing said article as a cathode.

13. A method according to claim 8, wherein said material and said teating agent are both in powder form and a paste prepared from a mixture thereof is applied to said article before they are heated.

14. A method according to claim 8, wherein said temperature is at least 450° C.

15. A method according to claim 1, wherein the material contains vanadium.

16. A method according to claim 1, wherein the material contains chromium.

17. A method according to claim 1, wherein the treating agent comprises an alkaline-earth-metal or alkali-metal cyanide.

18. A method according to claim 1, wherein the treating agent comprises an alkaline-earth-metal or alkali-metal cyanate.

19. A method according to claim 1, wherein the treating agent comprises an alkali-metal cyanide or cyanate.

20. A method according to claim 1, wherein the treating agent comprises an alkaline-earth-metal cyanide or cyanate.

* * * * *